US006302506B1

(12) United States Patent
Norton

(10) Patent No.: US 6,302,506 B1
(45) Date of Patent: Oct. 16, 2001

(54) APPARATUS AND METHOD FOR CORRECTING CARRIAGE VELOCITY INDUCED INK DROP POSITIONAL ERRORS

(75) Inventor: Kirkpatrick W. Norton, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/161,798

(22) Filed: Sep. 28, 1998

(51) Int. Cl.[7] ..... B41J 29/38
(52) U.S. Cl. ..... 347/14; 347/37
(58) Field of Search ..... 347/14, 37, 39

(56) References Cited

U.S. PATENT DOCUMENTS

| | | | | |
|---|---|---|---|---|
| 4,789,874 | * | 12/1988 | Majette et al. | 347/37 |
| 4,794,411 | | 12/1988 | Taub et al. | 346/140 R |
| 5,467,115 | | 11/1995 | Childers | 347/47 |
| 5,527,121 | | 6/1996 | Santon | 400/323 |
| 5,644,343 | | 7/1997 | Allen | 347/17 |
| 5,669,721 | | 9/1997 | Santon et al. | 400/279 |
| 5,685,074 | | 11/1997 | Pan et al. | 347/47 |
| 5,815,172 | * | 9/1998 | Moh | 347/37 |
| 5,889,534 | * | 3/1999 | Johnson et al. | 347/14 |
| 5,926,192 | * | 7/1999 | Yamane | 347/37 |
| 5,936,645 | * | 8/1999 | Niikura et al. | 347/37 |

OTHER PUBLICATIONS

Epstein, Howard C., Leonard, Mark G., Nicol, Robert. Economical, High–Performance Optical Encoders. Hewlett–Packard Journal, Oct. 1988, pp. 101 and 106.*

* cited by examiner

*Primary Examiner*—John Barlow
*Assistant Examiner*—Julian D. Huffman
(74) *Attorney, Agent, or Firm*—Jerry R. Potts

(57) ABSTRACT

In an inkjet printing machine, an ink drop positional error correction apparatus includes a position extrapolator that is responsive to conventional position encoder pulses and uses difference equations to predict future carriage positions by mapping a position profile of the traveling carriage to a polynomial equation of an arbitrary order for generating a series of nozzle firing subpulses that account for non constant carriage velocity. A fire pulse generator responsive to the subpulses further adjusts the firing time of the printing machine nozzles to correct for the carriage velocity induced ink drop positional errors for both non constant and constant carriage velocity conditions.

13 Claims, 6 Drawing Sheets

APPARATUS AND METHOD FOR CORRECTING CARRIAGE VELOCITY INDUCED INK DROP POSITIONAL ERRORS

RELATED APPLICATIONS

This application is related to U.S. patent application Ser. No. 09/162,369 entitled "Method and Apparatus for Compensating for Variations in Printhead-To-Media Spacing and Printhead Scanning Velocity In An Ink-Jet Hard Copy Apparatus," filed concurrently herewith this application on Sep. 28, 1998.

FIELD OF INVENTION

This invention relates generally to machines and procedures for printing text or graphics on printing media such as paper, transparency stock, or other glossy media; and more particularly to such a machine and method that constructs text or images from individual marks created-on the printing medium, in a two-dimensional pixel array, by a pen or other marking element or head that scans across the medium. The invention is particularly related to printers that operate by the thermal-inkjet process—which discharges individual ink droplets as a printhead slews across a print medium and a method for compensating for non uniform Printhead motion. As will be seen, however, certain features of the invention are applicable to other scanning-head printing processes as well.

BACKGROUND OF THE INVENTION

The operation of any scanning-head device in slewing the printhead across the medium to discharge ink droplets does present some obstacles to precise positioning of the printed marks, and also to best image quality. In order to describe these obstacles it will be helpful first to set forth some of the context in which these systems operate.

In many printing devices, position information is derived by automatic reading of graduations along a scale or so-called "encoder strip" (or sometimes "codestrip") that is extended across the medium. The graduations typically are in the form of opaque lines marked on a transparent plastic or glass strip, or in the form of solid opaque bars separated by apertures formed through a metal strip.

Such graduations typically are sensed electrooptically to generate an electrical waveform that may be characterized as a square wave, or more rigorously a trapezoidal wave. Electronic circuitry responds to each pulse in the wavetrain, signaling the pen-drive (or other marking-head-drive) mechanism at each pixel location—that is, each point where ink can be discharged to form a properly located picture element as part of the desired image.

These data are compared, or combined, with information about the desired image—triggering the pen or other marking head to produce a mark on the printing medium at each pixel location where a mark is desired. As will be understood, these operations are readily carried out for each of several different ink colors, for printing machines that are capable of printing in different colors.

In addition to this use of the encoder-derived signal as an absolute physical reference for firing the pens, the frequency of the wavetrain is ordinarily used to control the velocity of the pen carriage. Some systems also make other uses of the encoder signal—such as, for example, controlling carriage reversal, acceleration, mark quality, etc. in the end zones of the carriage travel, beyond the extent of the markable image region.

Now, standardized circuitry for responding to each pulse in the encoder-derived signal is most straightforwardly designed to recognize a common feature of each pulse. Thus some circuits may operate from a leading (rising) edge of a pulse, others from a trailing (falling) edge—but generally each circuit will respond only to one or the other, not both.

Such circuits have been developed to a highly refined stage. Accordingly it is cost-effective and otherwise desirable to employ one of these well-refined, already existing circuits relative to such compensation; however, in adapting such a preexisting design, several problems arise.

(a) Encoder dimensional tolerances—As noted earlier, the position of the pen carriage unit is monitored by a detector that reads a position encoder. In this regard, encoder-reading circuitry processes the encoder reader data to produce pulses each time the carriage unit moves a fixed distance, usually on the order of 1/75th or 1/1 50th of an inch. However, the drop placement on the print medium must be placed on spatial boundaries that are much smaller, such as down to 1/50,000th of an inch or even smaller. Unfortunately, the position encoder is not nearly this precise. Moreover, other problems are associated with the encoder dimensional tolerances. For example, the encoder-reading circuitry is triggered from the falling edges of the initial encoder-derived wavetrain. The alternating opaque markings and transparent segments (or solid bars and orifices) of the encoder strip are arranged in time alignment with the signals that result from reading of those features by a transmissive optical emitter/detector pair.

It will be understood that, in selecting the point at which a mark should be made, it is possible to make allowance for the nominal width of the transparent segment. For example, the firing of a pen could be delayed by a period of time automatically calculated from the nominal width of the transparent segment divided by the carriage velocity. Although both these pieces of information are available during operation of the system, the results of this method would be unsatisfactory because of preferred manufacturing procedures for creation of the encoder strip . These procedures arise from economics related to dimensional requirements, as follows.

Thus, in making a encoder strip, the dimension which is most important to hold to highest precision is the overall periodicity of the alternating opaque bars and transparent segments—i.e., the periodicity dimension that gives rise to a full wavelength of the wavetrain. The two internal dimensions of each mark-and-transparent-segment pair—namely, the length of the bar and the length of the transparent segment—are much less important.

In a unidirectional printing machine, only the distance between falling edges (or alternately rising edges) has any importance, provided only that (1) the distance from each falling edge to its next associated rising edge is great enough to permit the sensing apparatus to recognize the falling edge; and (2) the distance from each rising edge to its next associated falling edge is great enough to permit the sensing apparatus to reset itself in preparation for sensing the failing edge.

More specifically, the dimensional accuracy of the encoder-strip features are plus-or-minus only one percent for the full periodic pattern width, but plus-or-minus ten to twenty percent for the opaque bar width alone. While it would be entirely possible to manufacture an encoder strip with much finer precision in the internal dimensions just mentioned, an encoder strip so made would be substantially more expensive.

(b) Time-of-flight and analogous misalignment effects—A certain amount of time elapses between the issuance of a mark-command pulse to a print head and the mark actually being created on the printing medium. For instance, in an inkjet printer, some time elapses between: the issuance of a fire-command pulse—approximately at an encoder-wavetrain falling edge—to a pen nozzle and the instant when a resulting ink drop actually reaches the medium.

During this time, however, the carriage and pen continue to move across the printing medium—and, in the case of an inkjet device, so does the ink drop, even after leaving the pen. The initial velocity component of the drop along the scanning axis or dimension, when scanning forward, is very closely equal to the carriage velocity; this velocity likely decreases while the drop travels in the orthogonal axis or dimension toward the printing medium—but nevertheless, some forward movement or displacement of the ink drop along the scanning axis does occur before the drop reaches the medium to form an ink spot.

In a unidirectional printing machine, this delay is substantially inconsequential, once the carriage velocity of the pen is constant, for all the ink drops are offset in this same manner by very nearly the same distance, and in the same direction. In other words, the entire image is offset together along the scanning axis; but this does not matter to the resulting printed image because there are no relative offsets within the image—and therefore no discontinuities, no distortions of image features, etc.

Thus time-of-flight and analogous misalignment effects impede the creating high-accuracy images. While these effects are substantially independent of the imprecisions discussed in the preceding section, it should be recognized by those skilled in the art that in order to reduce printer cost and improve throughput, these two factors are critical.

Therefore it would be highly desirable to have a new and improved system that corrects for variations in the ink drop flight path due to changing carriage velocity, and that also adjusts the extrapolated positions at which drops are fired to account for a non-constant carriage velocity.

In order to have precise positioning information, other factors, such as carriage velocity and acceleration must also be considered. The relationship between position and movement factors will now be expanded to provide a better understanding of the advantages of the present invention.

As discussed earlier a well-known way to provide the position and speed information is by means of at least one electro optical sensor that is moved in accordance with the print-head or reading-head movement, and that monitors a so-called "encoder scale". Because plural-sensor systems are more complex and expensive than single-sensor systems, the present invention is limited to single-sensor systems.

In either a single-or a plural-sensor system, the scale is disposed in correspondence with positions (that is, the full range of positions) of the head across the image-bearing sheet. Such a scale generally takes one of two forms: (1) a linear strip (often denominated "codestrip") extended—and usually tensioned—across a bed or channel that holds the image-bearing sheet, the strip being directly adjacent and parallel to the print-head or reading-head motion; and (2) a circular, hub-mounted scale read against—for example—the shaft of a motor that drives the print head.

Every such system has some arrangement for initializing the counting of graduations, starting precisely at a well-defined edge of the image area. Counting then continues across that area within a controlled range of speed so that the automatic equipment can, in effect, lock onto the progressively changing position. Once initialized, the system can maintain this lock as long as movement continues in the same direction.

It will be understood that for fine positional precision the graduations are spaced very closely, and accordingly each graduation must necessarily be very narrow. The stopping distance and precision of the marking or reading head—for rapid scanning such as called for by high throughput—is not readily made equal to a small fraction of the periodicity of these fine graduations.

Therefore the ambiguity cannot be easily resolved by design adjustment of the relative magnitudes of graduations vs. stopping precision.

One well-known way to resolve the ambiguity is to provide not just one but two sensors, both reading the same codestrip but mutually offset along the line of motion by a known distance. In particular it is known in such a so-called "dual-channel encoder" to offset the two sensors by one-quarter of the overall periodicity of the graduations on the encoder scale (or by that distance plus or minus an integral number of periodicities), resulting in two electrical pulse trains in quadrature.

The velocity and acceleration of the print-head is then ascertainable automatically through comparison of the two pulse trains. Such systems work well but are objectionably expensive in that they require an additional sensor and associated electronics.

Another method has been to provide a circuit to estimate the velocity of the pen carriage and then shoot the drops of ink at the time when the carriage is predicted to be in the proper position. This process has historically been called position extrapolation: predicting future positions based on the time of occurrence of past positions. Based on the current estimate of the pen carriage velocity, a circuit is able to create a sequence of "subpulses" that occur when the carriage is expected to be in positions that are very close together. These subpulses provide a positional reference estimate that is much higher in resolution than the original encoder pulses.

Another practice of past inkjet printers has been to print only when the pen carriage is sweeping at a constant velocity. In such system, the carriage must accelerate from being stationary to traveling at the set print speed before printing may begin for a given sweep. This acceleration requires both time (which slows down printer performance by limiting the number of pages that can be printed in a fixed amount of time) and travel distance (which forces the printer to have added width making the product much larger).

To reduce printer cost and improve throughput, it would be highly desirable to have a new and improve printer and method of printing that permits printing while the carriage is accelerating. Such a new an improved printer should also accurately determine ink droplet positioning to ensure that such droplets hit the medium at a proper position.

SUMMARY OF THE DISCLOSURE

The present invention introduces such refinement. The invention has several facets or aspects, which can be used independently—although for best enjoyment of all the advantages of the invention these aspects are preferably used together.

In preferred embodiments of a first of its facets, the present invention takes into account the variation in the ink drop flight path due to changing carriage velocity and determines extrapolated positions at which drops are fired to account for the non-uniform or non-constant velocity of the pen carriage. With respect to this later factor the present invention includes a second order position extrapolator that employs a difference equation technique to estimate a polynomial equation of an arbitrary order that approximates the position profile of the pen carriage over the last several encoder pulse intervals. Resequencing of the polynomial curve at smaller intervals is then achieved to provide a series of subpulses that represent estimates of when the carriage will be at small increments in position based on the past carriage behavior.

According to another aspect of the present invention, another set of difference equations are employed with resequencing of the polynomial. Instead, the time of the next encoder pulse is estimated (extrapolated) base on the N-order polynomial, but the subpulses are simply linearly interpolated between this time and the time of the last encoder pulse.

BRIEF DESCRIPTION OF THE DRAWINGS

The above mentioned features of this invention and the manner of attaining them will become apparent, and the invention itself will best be understood by reference to the following description of the embodiments of the invention in conjunction with the accompanying drawings, wherein.

BEST MODE FOR CARRYING OUT THE INVENTION

Figure 1:
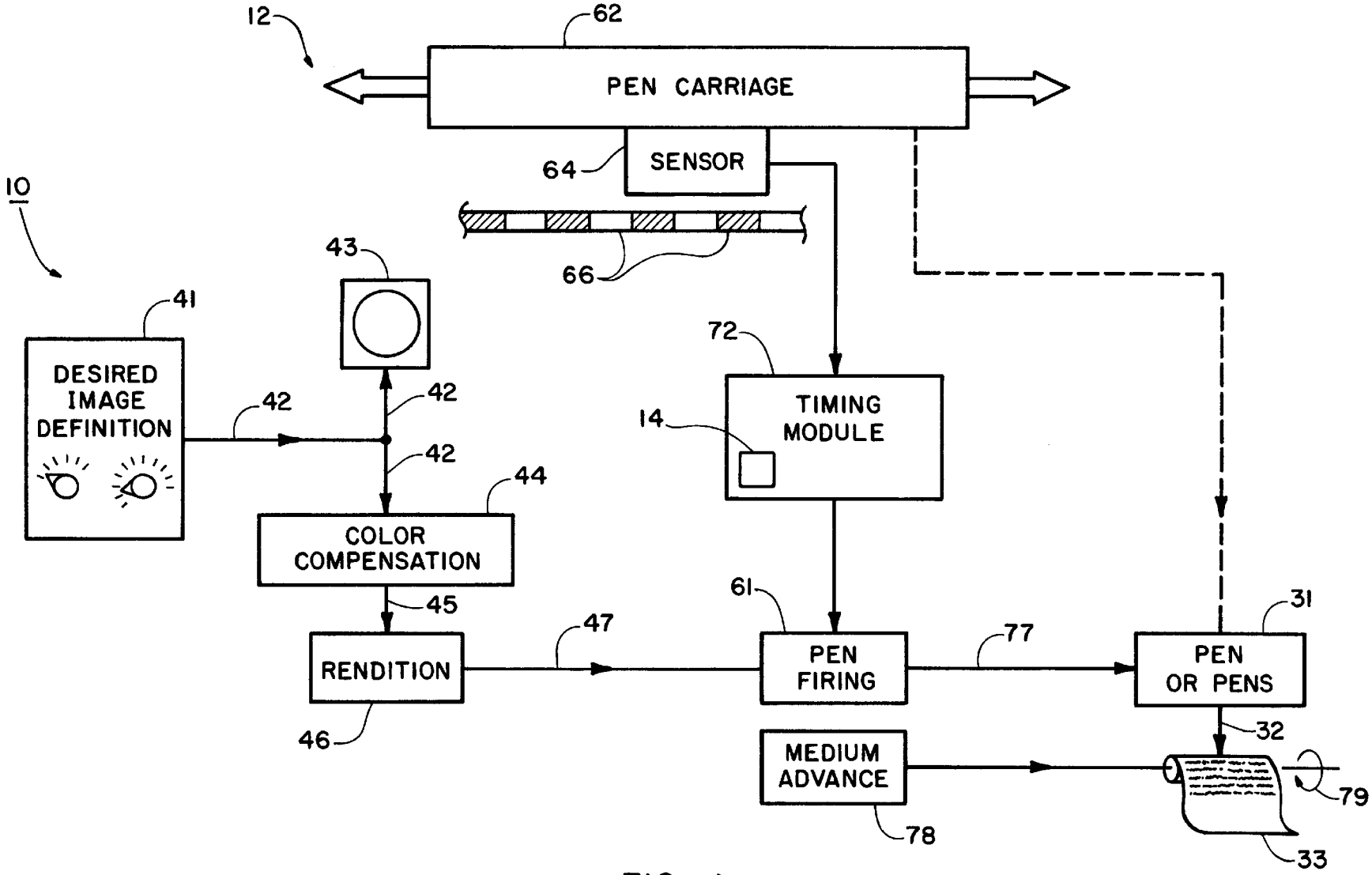
FIG. 1 is generalized block diagram of a document reproduction system having a printing system which is constructed in accordance with the present invention.

Referring now to the drawings and more particularly to FIG. 1 thereof, there is illustrated a document reproduction system 10 which is constructed in accordance with the present invention. The new and improved document reproduction system 10 includes a printing system 12 that automatically corrects for carriage velocity induced ink drop position errors in accordance with a novel correction method of the present invention.

The system 10 generally includes a printing system 12 coupled to an input stage 41 having an output indicated generally at 42. The input stage 41 may include manual controls (not shown) to provide information defining the desired image. The output 42 of the input stage 41 may proceed to a display 43 if desired to facilitate esthetic or other such choices; and, in the case of color printing systems, to a color-compensation stage 44 having an output 45. The color-compensation stage 44 corrects for known differences between characteristics of the display 43 and/or input source 41 system relative to the printing system 12.

The printing system 12 includes a pen carriage unit 62 having one or more pen cartridges 31 mounted therein for ejecting droplets of ink 32 onto a print medium 33. An electro-optical position sensor 64 mounted to the carriage unit 62 cooperates with an encoder strip 66, a timing module 72, and a pen firing control circuit 61 to help facilitate determining carriage unit position, velocity and acceleration for pen firing purposes as will be explained hereinafter in greater detail.

The output 45 from the compensator 44 is coupled to a rendition stage 46 having an output 47. The rendition stage 46 helps determines how to implement the desired image at the level of individual pixel-position printing decisions—for each color, if applicable. The resulting output 47 from the rendition stage 46 is directed to the pen firing control circuit 61 that determines when to direct a firing signal 77 to each pen cartridge 31.

The pen discharged ink droplets 32 form images on paper or some other printing medium, such as the print medium 33. Meanwhile typically a medium-advance module 78 provides relative movement 79 of the medium 33 in relation to the pen 31.

To improve the output quality (accuracy) when printing, the novel correction method employs a difference equation technique implemented at the silicon level on a custom integrated circuit 14 forming part of the timing module 72 that will be described hereinafter in greater detail. The integrated circuit 14 within the timing module 72 causes an estimated polynomial equation of arbitrary order to approximate the position profile of a cartridge carriage unit 62 that sweeps one or more pen cartridges 31 above the print medium 33. In approximating the position profile of the carriage unit 62, the correction method approximates the position profile of the pen carriage unit 16 over a previous predetermined number of encoder pulse intervals. Resequencing of this polynomial curve at smaller intervals can then provide a series of subpulses that represent estimates of when the carriage unit 62 will be at small increments in position based on the past behavior of the carriage unit 62 relative to it velocity and acceleration factors.

As will be explained hereinafter in greater detail, in another preferred embodiment of the present invention, that employs difference equations but not the resequencing of the polynomial, subpulses are treated as simply linearly interpolated values between a current time and the time of the last encoder pluse.

Figure 2:
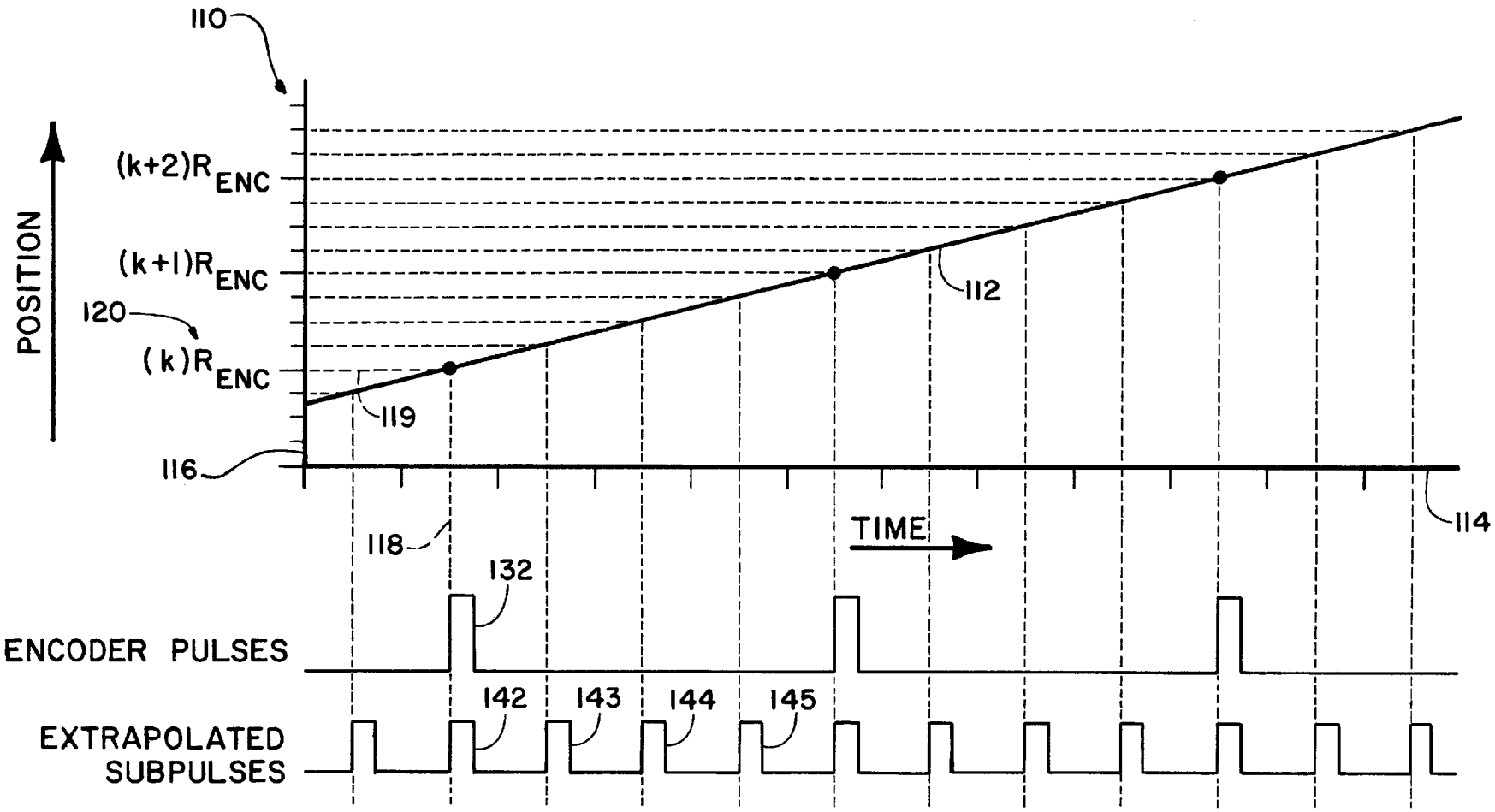
FIG. 2 is a graphical representation of a first order velocity position profile of a carriage unit of FIG. 1, illustrating corresponding encoder pulses and subpulses generated from such a profile.

Considering now the correction method in greater detail, FIG. 2, illustrates a first order position profile 110 of the carriage unit 62 and corresponding encoder pulses and subpulses generated from the sensor 64 and the timing module 72 respectively. The position profile 110 is plotted relative to a horizontal axis 114 indicative of time and a vertical axis 116 indicative of distance or position.

The constant velocity of the carriage unit 62 is represented by a straight sweep line 112 that is plotted relative to the time axis 114 and the position axis 116. Each time the carriage unit position sensor 64 passes an encoder boundary, such as an encoder boundary representation 118 indicative of the boundary position 120 an encoder pulse is generated, such as an encoder pulse 132. In response to each encoder pulse 132, the timing module 72 generates a series of subpulses, such as the subpulses 142–145. By extending imaginary lines, such as the imaginary line 118 from the leading edge of each of the subpulses, to the sweep line 112 and then horizontally by another imaginary line, such as an imaginary line 119 position locations can be determined. In the present explanation of the current invention, the subpulse interval has been established at one fourth of that of the encoder boundaries. Those skilled in the art will appreciate that other interval time periods may also be employed without distracting from the true scope and spirit of the present invention.

Figure 3:
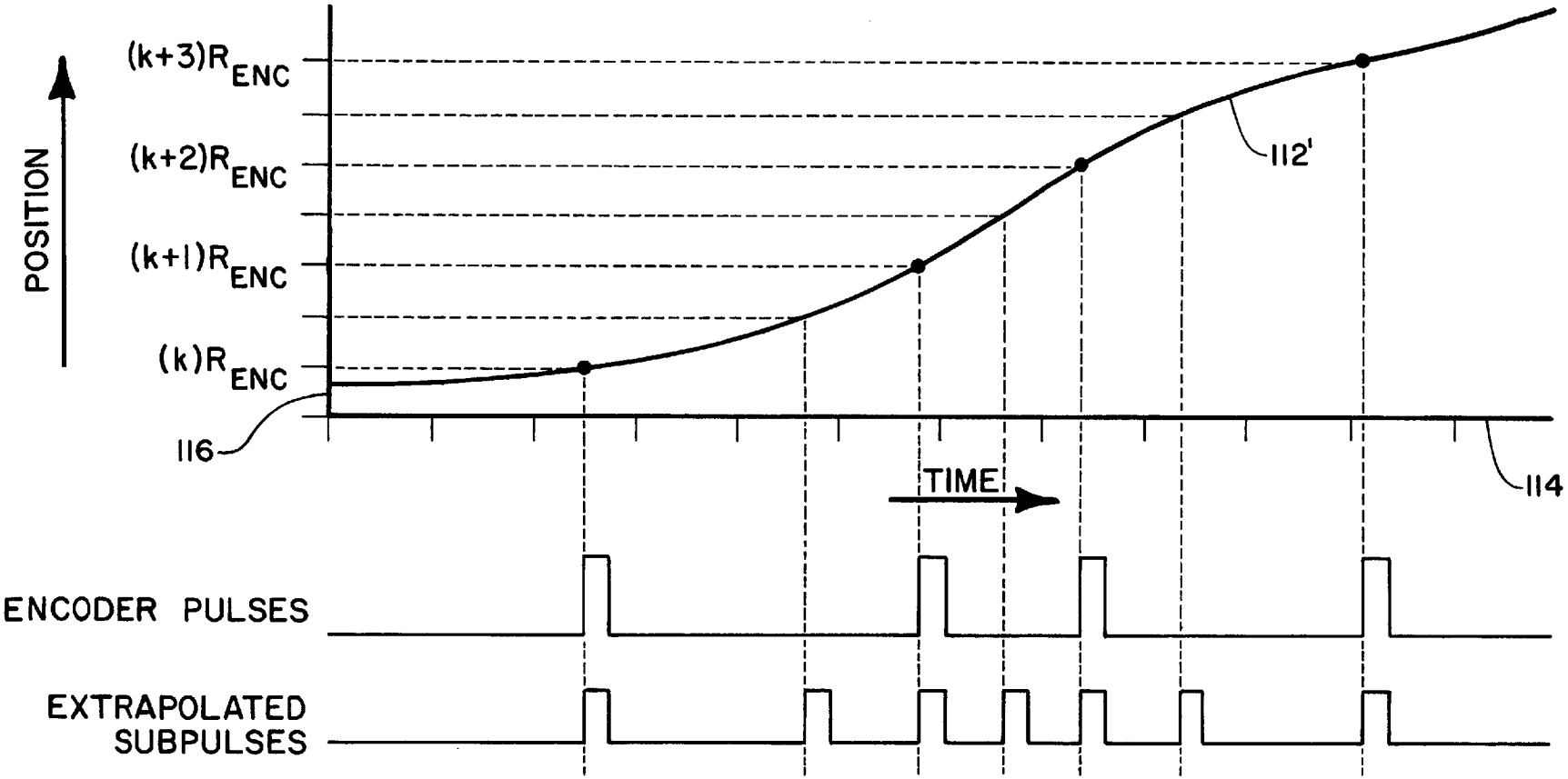
FIG. 3 is another graphical representation of a first order velocity position profile of a carriage unit of FIG. 1, illustrating a non constant velocity sweep line.

Because velocity is constant, the spacing between the encoder pulses 132 and the subpulses 142–145 is fixed at constant time intervals. It should be understood by those skilled in the art that if the velocity of the carriage unit 62 is not constant, the sweep line (in this case sweep line 112' would not be a straight line, and the spacing intervals between encoder pulses and timing subpulses would vary as best illustrated in FIG. 3.

Figure 4:
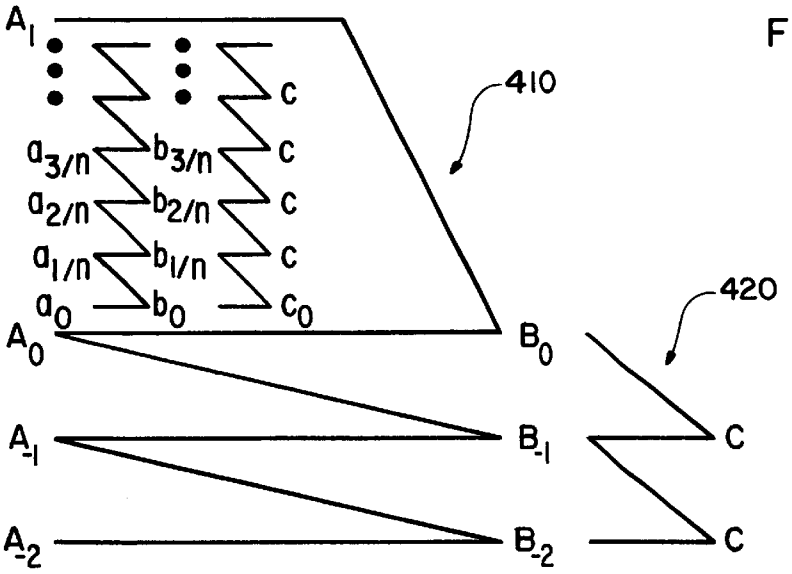
FIG. 4 is a diagrammatic representation of a differential partial sequence of the third order.

FIG. 4, illustrates a differential partial sequence of the 3rd order 410 represented by the capital letters $A_{-2}$, $A_{-1}$, $A_0$, and $A_1$(sometimes referred to as the "extrapolator sequence"). A difference sequence 420 is also illustrated in FIG. 4, where the difference sequence for the sequence A is represented by the B sequence. The C sequence is constant representing the difference between consecutive B values. In the extrapolator sequence 420 the discrete values of $A_{-2}$, $A_{-1}$, $A_0$, and $A_1$, represent the time intervals between the last three encoder pulses. The value of $A_1$ is the unknown time interval to the next encoder pulse.

The main sequence difference is given by the equations 1–3 that follow:

$$C = \text{constant (3rd order)}. \qquad \text{equation 1}$$

$$B_K = B_{K-1} + C. \qquad \text{equation 2}$$

$$A_K = A_{K-1} + B_{K-1}. \qquad \text{equation 3}$$

In order to determine a new subsequence, such as a subsequence "a," a predetermined number "n" of subsequence steps must be established. The n number of subsequence steps are represented by $a_{3/n}$, $a_{2/n}$, $a_{1/n}$, and a for example, This is necessary as the subsequence is indicative of the number of subpulses that will be generated between encoder pulses.

The subsequence difference is given by equation 4–6 as follows:

$$c = \text{constant (3rd order)}. \qquad \text{equation 4}$$

$$b_K = b_{K-1} + C. \qquad \text{equation 5}$$

$$a_K = a_{K-1} + b_{K-1}. \qquad \text{equation 6}$$

It should be noted from FIG. 4, that both sequence "A" and subsequence "a" are of the third order since they both have non-zero differences out to the third difference. The main sequence has a constant 3rd order difference of C given by equation 1, and the new sequence has a constant 3rd order difference of c given by equation 4. The timing module 72 derives the initial conditions for the new sequence, $a_0$, $b_0$ and $c_0$ from the main sequence. In this regard, once the initial conditions are determined, the balance of the new sequence is calculated using the incremental equations, equations 1–6.

From the foregoing, those skilled in the art will understand that the extrapolator sequence defines a set of polynomial difference equations in order to facilitate determining a new subsequence of other polynomial difference equations defined by equation 1–3

In developing its firing-signal determination, the firing circuit 61 must take into account the position of the pen carriage 62. Such accounting is enabled by operation of the sensor 64 that rides on the carriage 62 and its reading of the encoder strip 66.

Considering now the sequential restepping technique in greater detail, the subsequence is offset from the main sequence by one half of a subpulse interval. This may not always be necessary, but such an offset does have an illustrative advantage in the example test case. In this regard, the offset reduces the likelihood of the last subpulse occurring either too close to the encoder pulse or being hidden by it due to errors in the predicted carriage movement.

It should be noted by those skilled in the art that in using the offset approach, there is actually a fourth initial condition that is needed. In this regard, the offset to the first subpulse at $a_0$ from the encoder pulse at $A_0$ is really part of a third sequence that has one half the positional increment of the subsequence. If instead the main sequence and the subsequence are synchronized, the equations for the first and second differences are different and this extra term is not needed, but the process is essentially the same.

To find values for $a_0$, $b_0$, $c_0$, as a function of $A_0$, $A_0$, $A_2$, the sequence diagram illustrated in FIG. 4 may be utilized to derive the relationships between these values. The results of this derivation for the equations implemented within the integrated circuit of the timing module 72, where the value of n=the number of subpulses per encoder interval, are shown in equations 7–10 as follows:

$$\begin{aligned} a_0 = {} & A_0 * [(11/(12n)) + (1/(4n^2)) + (1/(48n^3))] - \\ & A_{-1} * [(7/(12n)) + (3/(8n^2)) + (1/(24n^3))] + \\ & A_{-2} * [(1/(6n)) + (1/(8n^2)) + (1/(48n^3))] \end{aligned} \qquad \text{equation 7}$$

$$\begin{aligned} a_1 = {} & A_0 * [(11/(6n)) + (2/(n^2)) + (7/(24n^3))] - \\ & A_{-1} * [(7/(6n)) + (3/(n^2)) + (13/(12n^3))] + \\ & A_{-2} * [(1/(3n)) + (1/(n^2)) + (1/(24n^3))] \end{aligned} \qquad \text{equation 8}$$

$$\begin{aligned} b_1 = {} & A_0 * [(2/n^2) + (1/(2n^3))] - \\ & A_{-1} * [(3/n^2)) + (1/(n^3)] + \\ & A_{-2} * [(1/n^2) + (1/2n^3))] \end{aligned} \qquad \text{equation 9}$$

$$c = A_0 * [1/n^3] - A_{-1} * [2/n^3] + A_{-2} * [1/n^3] \qquad \text{equation 10}$$

Utilizing equations 7–10, the first subpulse is generated at time $a_0$ after the last encoder pulse, which will correspond to the time at which the carriage unit 62 is one half of one $n^{th}$ of an encoder interval from the last encoder boundary. The next subpulse is generated when the carriage is expected to be one $n^{th}$ of an encoder interval from its position at the occurrence of the last subpulse, given by the value of $a_1$. The remaining subpulses are generated at times that are functions of the incrementing (or decrementing) difference values as shown in the discrete sequence diagram (FIG. 4) where $a_K=a_{K-1}+b_{K-1}$, and $b_K=b_{K-1}+c$. As a result of this operation, a resulting pulse profile is developed as illustrated in FIG. 5.

Figure 5:
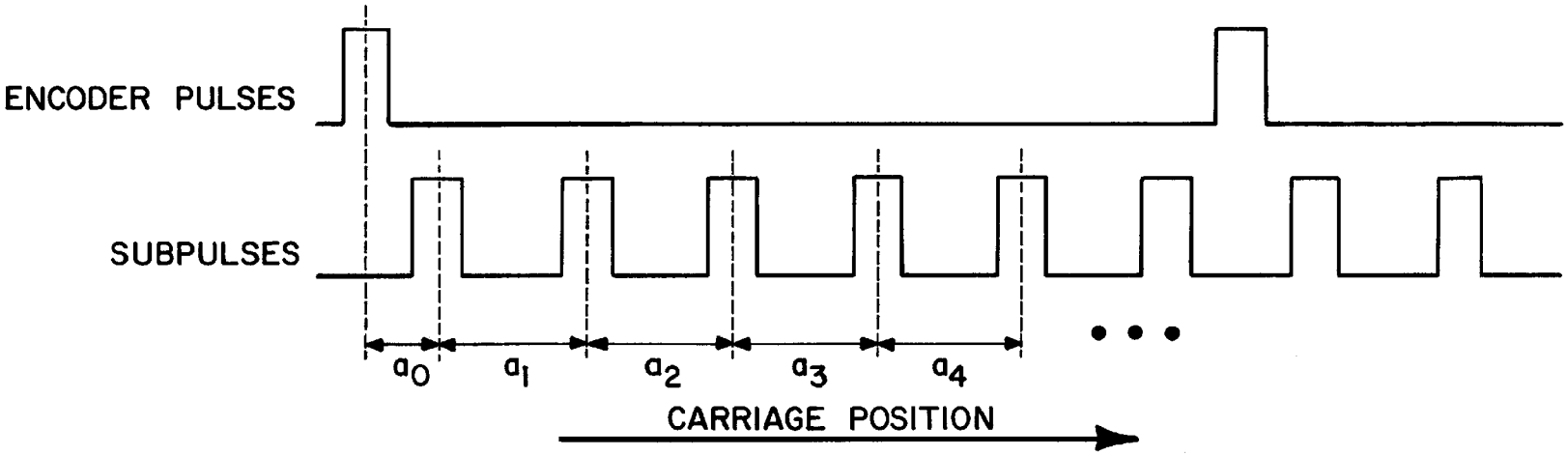
FIG. 5 is a diagrammatic representation of a corrected pulse profile using the novel method of flight path correction of the present invention.

As best seen in FIG. 5, the generated subpulses are referenced from the encoder pulses. The spacing between the subpulses is shown as being constant. The subpulse sequence is offset from the encoder pulse sequence by one half of a subpulse interval, but as mentioned earlier, this is not a requirement.

When the subpulses as illustrated in FIG. 5 are utilized to fire ink droplets from the pen 31, the drops will be fired when the pen carriage unit 62 is positioned at regularly spaced intervals as long as the carriage position profile can be mapped to an n-order polynomial. In short then, using this technique, drop placement on the print medium 33 is more accurate and thus, will more readily help hide visual print artifacts induced by printing during non uniform carriage motion.

As mentioned earlier, a less intensive algorithm that does not require resequencing may be employed as a second preferred embodiment whenever reduced accuracy is acceptable. The equations for the non sequenced algorithm can be derived by referring back to the discrete sequence diagram (FIG. 3), where the main sequence interval $A_1$ is considered using equations that follow the progression of Pascal's Triangle as set forth in equations 11–14, etc.:

$$A_1 = A_0 \qquad \text{equation 11}$$

$$A_1 = 2A_0 - A_{-1} \qquad \text{equation 12}$$

$$A_1 = 3A_0 - 3A_{-1} + A_{-2} \qquad \text{equation 13}$$

$$A_1 = 4A_0 - 6A_{-1} + 4A_{-2} - A_{-3} \qquad \text{equation 14}$$

Once $A_1$ is computed, the subpulse intervals within the main sequence interval can be approximated by linearly interpolating across the interval in time. This method would produce the correct number of subpulses within the $A_1$ interval, but the spacing of the subpulse intervals would not be precise. Thus, if this approximate error is acceptable, the problem of printing during non uniform carriage velocity can be readily solved using this simplified approximation.

Digressing for a moment, as mentioned earlier, in a typical inkjet printer system, the pens 31 are held in a carriage unit, such as the carriage unit 62, that sweeps back and forth across the medium 33 as the pens 31 shoot or eject droplets of ink onto the medium 33. Historically, this printing has taken place only when the pen carriage unit 62 is traveling at a relatively constant speed or velocity. The number of pages printed per minute or the throughput of the printer is, among other things, a function of the time it takes to sweep the pen carriage unit 62 across the medium 33. If the sweep time can be reduced, printer performance is improved since its throughput is increased. Thus, since time is required to accelerate the pen carriage from a stationary state to a constant velocity, the seep time is increased ( and performance decreased) due to the non printing acceleration interval. As will be explained herein after, the present invention includes a correction algorithm that facilitates accurate printing during this acceleration time period. Such a correction algorithm has the added advantage, since physical space is required for acceleration to take place, of substantially reducing the width requirement of the printer so that the final product or printing system 12 is not only faster but is also smaller and thus less expensive to manufacture.

A further method of improving throughput is to print when the pen carriage motion controls facilitate bidirectional printing. In using a bidirectional technique for printing, the retrace time of the pen carriage unit 62 is utilized to eject at least a portion of the image ink droplets, such as a half of the ink droplets. Heretofore, both of the above mentioned improvements have been difficult to achieve because implemention results in visible artifacts in the printed image. This has been recognized to have been caused by the non uniform velocity of the pen carriage unit which in turn directly effects the flight path of the ink droplets as they travel through the air from the pen to the medium.

A third preferred embodiment of the present invention, as will be described hereinafter in greater detail, provides improved dot placement accuracy and is particularly useful for printers that print either while sweeping the pens in both directions (bidirectional printing) or when the sweep speed is not constant (printing while accelerating). While printing, the pen carriage unit 62 has a horizontal motion that is imparted to a drop of ink when it is fired from the pen 31. Because some time is required for the drop to travel from the pen 31 to the medium 33, this horizontal motion induces an error in dot position relative to the medium 33.

Consider the following, if the carriage unit 62 is traveling as some velocity V, and the flight time of the drop is t, the actual drop position will occur at a distance d where the distance d is derived from equation 15 as follows:

$$\text{distance}=d=\text{velocity } (V)*\text{time } (t) \qquad \text{equation 15}$$

The distance d, ignoring air resistance and other world complexities is otherwise known as flight path error. For unidirectional printers, with uniform velocity printing, this induced positional error is not of a concern since all drops are offset by the same amount. However, if the carriage velocity is not constant during printing, the positional error will vary and may well induce visible print artifacts. The present invention solves this positional error problem.

Figure 6:
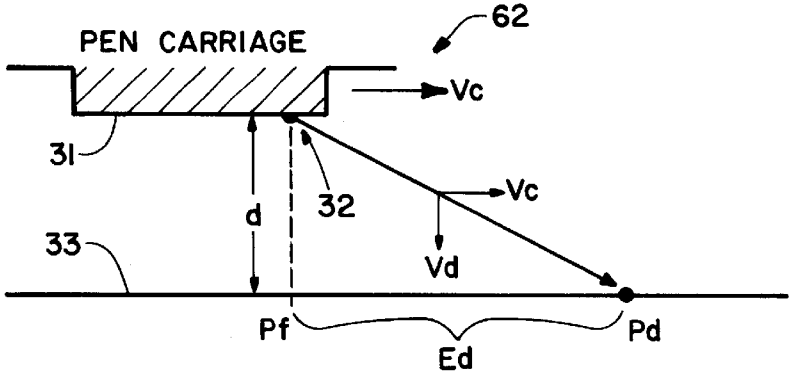
FIG. 6 is a diagrammatic representation of a dot position error induced by carriage velocity.

Referring to FIG. 6, the concept of carriage velocity induced dot position errors will be considered in greater detail. As indicated in FIG. 6, the distance d is the vertical distance between the nozzle plates of the pens 31 carried by the carriage unit 62 and the medium upon which the ejected droplets will be placed. Assuming ideal conditions with no air resistance, the dot position $P_d$ is given by equation 16 as follows:

$$P_d=P_f+V_c t=P_f+V_c(d/V_d) \qquad \text{equation 16}$$

Where $P_f$ is the position at which the droplet was fired.

$P_d$ is the medium position of the fired droplet.

$e_d$ is the induced error in dot position.

$V_d$ is the drop velocity in a vertical path of travel.

If correction is required to make the dot position at $P_f$, the new firing position $P_f$* before $P_f$ is given by equation 17 as follows:

$$P_f{*}V_c(d/V_d) \qquad \text{equation 17}$$

It the velocity is changing, the uncorrected dot position error $e_d$ changes as well, so that the spacing between dots will vary across the printing medium 33, potentially inducing a visible print artifact.

Likewise, if bidirectional printing is utilized, the value of the uncorrected dot position error $e_d$ alternates between positive and negative values depending on the direction path of the carriage unit 62. This alternating reversal of directions may well also induce visible print artifacts on the printing medium 33.

By employing a firing lead time based on the current carriage position and velocity, the spacing between the dot on the printing medium 33 can be substantially controlled to provide uniform spacing, even during printing with a varying carriage velocity.

Figure 7:
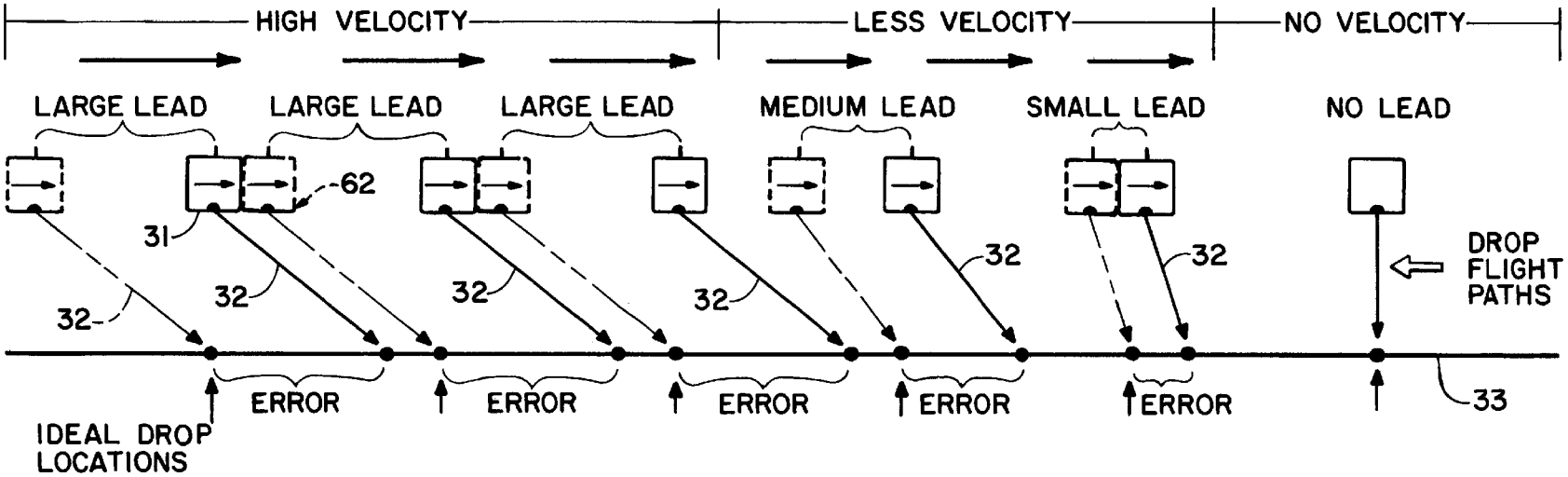
FIG. 7 is a diagrammatic representation of ink droplet flight paths under non uniform carriage velocity conditions.

Considering now the correcting of errors in dot position induced by a changing carriage velocity in greater detail with reference to FIG. 7, it can be visually seen in FIG. 7 that as droplets are fired at regularly spaced position intervals when the pen carriage unit 62 slows down, results in induced errors. In this regard, the induced error in dot position is seen as a varying spacing between adjacent dots deposited on the printing medium 33 for firing (at an earlier time) based on the horizontal velocity of the carriage unit 62. Ideally, the adjacent ink droplets or dots deposited on the printing medium 33 should be evenly spaced apart from one another.

Figure 8:
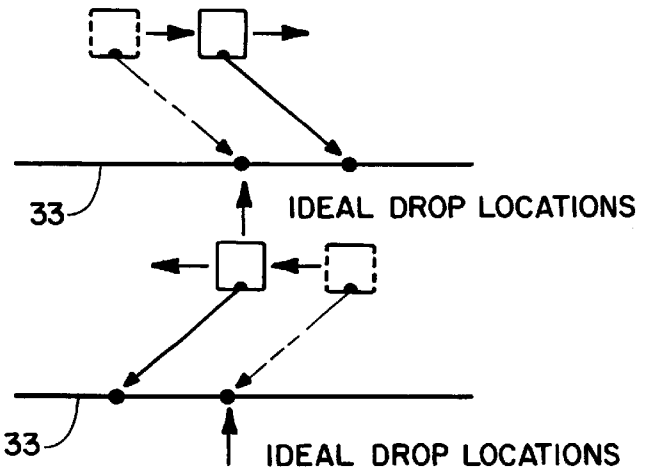
FIG. 8 is a diagrammatic representation of dot position error induced by a carriage unit traveling in a bidirectional path.
Figure 9:
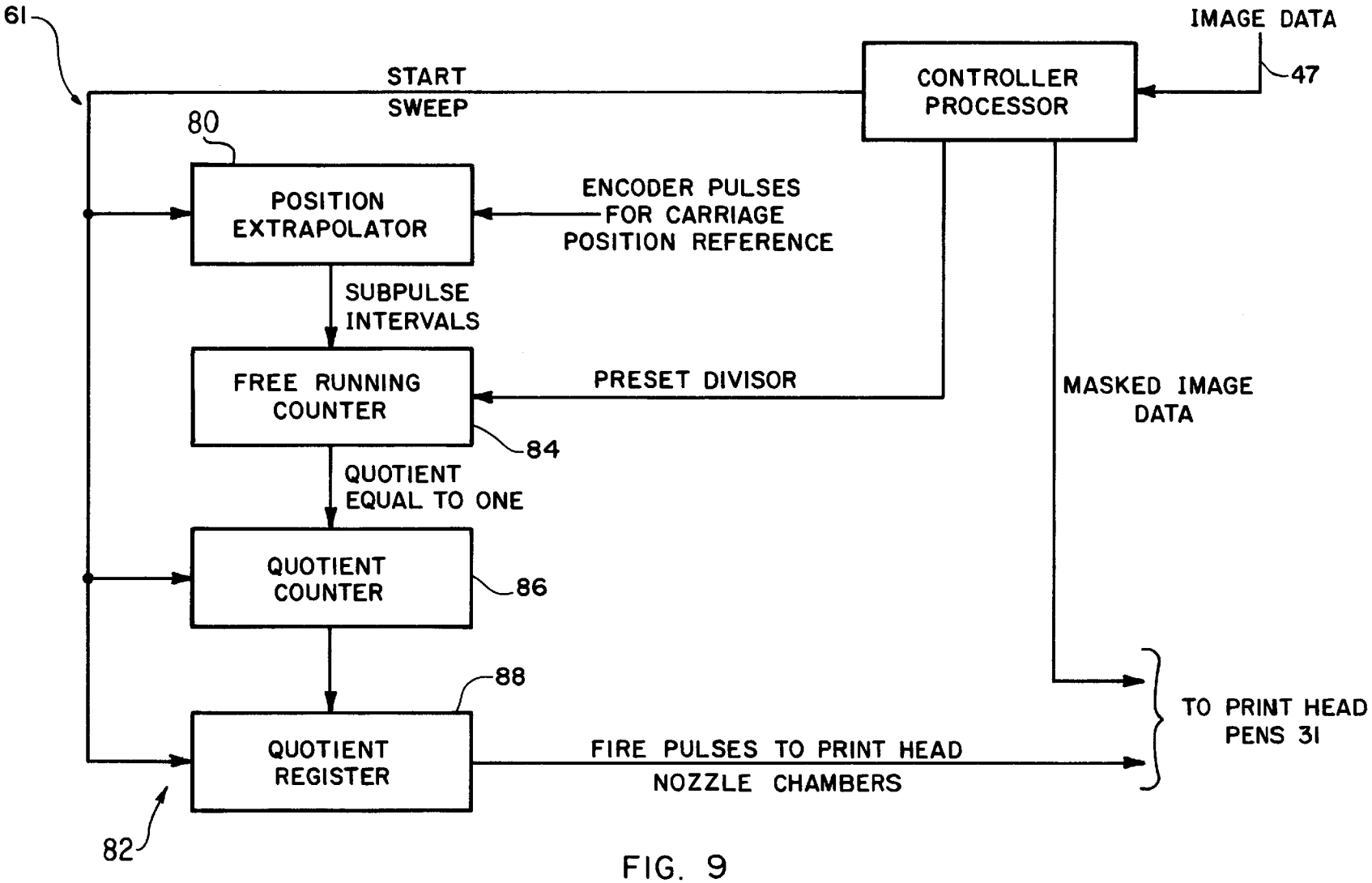
FIG. 9 is a generalized block diagram of a pen firing module forming part of the printing system of FIG. 1.

FIG. 7 clearly illustrates that the amount of lead time correction is proportional to the horizontal carriage velocity. FIG. 8 illustrates the lead time correction factor for bidirectional printing. In short then, by using a firing lead time, two drops can be placed on top of each other even if fired while the carriage 62 is moving in opposite directions. When correction is not applied, visual print artifacts may well appear on the printing medium.

Drop positional errors are corrected in real time by adjusting the time at which each drop is fired. Correction takes place at the hardware level so it is transparent to the controlling firmware. In this regard, when the pen carriage 62 is traveling at high speed, drops are automatically fired earlier. Conversely, when the pen carriage 62 is traveling at low speeds, less lead time is needed so the firing time is delayed. The lead time values are a function of the velocity, so monitoring the velocity enables a lead time value to be either calculated from this velocity, or the velocity can be utilized as an index value into a lookup table to get the lead time. In a simple example that ignores the effects of air, the lead time is a linear function of the velocity. In the real world however, a more complicated function or a lookup table proves to provide a more accurate solution.

In one preferred embodiment, the pen firing circuit 61 is implemented with a position extrapolator 80 to provide a fairly accurate position reference and a fire pulse delay generator 82. The optical encoder 66 provides a positional reference of one encoder pulse at fixed position intervals, The extrapolator circuit 80 utilizes this reference to predict future positions of the carriage 62 and generates subpulses that represent smaller increments in position. For instance, the extrapolator 80 can be configured to generate 20 subpulses per encoder interval. The delay generator 82 times the interval between encoder pulses to determine the carriage velocity using a free-running divide counter 84 and a quotient counter 86. The divide counter 84 divides the encoder pulse interval time by a preset divisor by counting down from the divide value to 1, then resetting to the divide value and repeating the sequence. Each time the counter 86 reaches the value of 1, the quotient counter 86 is incremented. At the end of the interval, a quotient register 88 associated with the quotient counter 86 contains the number of extrapolator pulses by which to delay the fire pulse from the encoder pulse. This implementation is extremely simple and provides an excellent solution.

It should be understood by those skilled in the art that the pen firing circuit 61 can be implemented utilizing a higher order equation for the delay estimate to account for the higher complexity and non-linearities of a real-world system. However, the simple estimate utilized is a sufficiently accurate estimate for most ink jet printing applications. Table A which follows provides the detailed description for the pen firing module 61.

TABLE A

```
module fcExtrapDelayFiring
 (Clk, Rst, DataIn, EncPulse, SubPulse, LoadDivisor, LoadMaxInterval, DelayedPulse);
input     Clk;                          // System clock
input     Rst;                          // System reset
input     [15:0] DataIn;                // T-bus data input
input     EncPulse;                     // Encoder pulse input
input     SubPulse;                     // Extrapolated sub-pulse position reference
input     LoadDivisor;                  // Load pulse for the max and min delays
input     LoadMaxInterval;              // Load pulse for the max and min intervals
output    DelayedPulse;                 // Flight-time-corrected firing pulse
wire      DelayedPulse;
reg [15:0] _DivideValue;          // Divide value for interval counter
wire [15:0] _NextDivideValue;
reg [7:0] _MaxInterval;           // Maximum interval length
wire [7:0] _NextMaxInterval;
reg [7:0] _IntervalCount;         // Interval counter
wire [7:0] _NextIntervalCount;
reg [15:0] _DivideCount;          // Divide counter
wire [15:0] _NextDivideCount;
reg [7:0] _DelayCount1;           // Pulse delay counter #1
wire [7:0] _NextDelayCount1;
reg [7:0] _DelayCount2;           // Pulse delay counter #2
wire [7:0] _NextDelayCount2;
// synopsys sync_set_reset "Rst"
// Divisor register
assign_NextDivideValue =
        (Rst == 1'b1)?
          16'd0
        :(LoadDivisor == 1'b1)?
          DataIn
        :
          _DivideValue;
// Maximum interval length register
assign NextMaxInterval =
```

TABLE A-continued

```
        (Rst == 1'b1)?
          8'd0
        :(LoadMaxInterval == 1'b1)?
          DataIn[7:0]
        :
          _MaxInterval;
// Interval counter
assign _NextIntervalCount =
        (Rst == 1'b1)?
          8'd0
        :(EncPulse == 1'b1)?
          8'd0
        :(_DivideCount == _DivideValue)?
          (_IntervalCount == _MaxInterval)?
            _IntervalCount
          :
            IntervalCount + 1+b1
        :
          _IntervalCount;
// Interval divider
assign _NextDivideCount =
        (Rst == 1'b1)?
          16'd0
        :(EncPulse == 1'b1)?
          16'd1
        (_DivideCount == _DivideValue)?
          16'd1
        :
          _DivideCount + 1'b1;
// Delay counter #1
assign _NextDelayCount1 =
        (Rst == 1'b1)?
          8'h00
        :(EncPulse == 1'b1 && _DelayCount1 == 8'd0)?
          _IntervalCount
        :(SubPulse == 1'b1)?
          (_DelayCount1 == 8'd0)?
            8'd0
          :
            _DelayCount1 - 1'b1
        :
          _DelayCount1;
// Delay counter #2 (Used only if counter #1 is busy)
assign _NextDelayCount2 =
        (Rst == 1'b1)?
          8'hFF
        :(EncPulse == 1'b1 && _DelayCount1 != 8'd0)?
          _IntervalCount
        :(SubPulse == 1'b1)?
          (_DelayCount2 == 8'd0)?
            8'd0
          :
            _DelayCount2-1'b1
        :
          _DelayCount2;
always @(posedge Clk) _DivideValue <= _NextDivideValue;
always @(posedge Clk) _MaxInterval <= _NextMaxInterval;
always @(posedge Clk) _IntervalCount <= _NextIntervalCount;
always @(posedge Clk) _DivideCount <= _NextDivideCount;
always @(posedge Clk) _DelayCount1 <= _NextDelayCount1;
always @(posedge Clk) _DelayCount2 <= _NextDelayCount2;
assign DelayedPulse =
        (_DelayCount1 == 8'd1 || _DelayCount2 = 8'd1)?
          (SubPulse == 1'b1)?
            1'b1
          :
            1'b0
        :
          1'b0;
endmodule
```

While particular embodiments of the present invention have been disclosed, it is to be understood that various different modifications are possible and are contemplated within the true spirit and scope of the appended claims. Thus for example, a look up table could be made available that includes data that is indicative of flight path delay profiles as a function of carriage velocity. In such a configuration, the measured carriage velocity would be utilized to index a delay value retrievable from the lookup table. The advantage of this approach is that highly complex delay functions may be represented in the lookup table without adding any substantial cost to the system. It will be understood therefore that the foregoing disclosure is intended to be merely exemplary, and not to limit the scope of the invention—which is to be determined by reference to the appended claims.

We claim:

1. A printing apparatus comprising:

a pen carriage assembly for ejecting droplets of ink onto a print medium, said pen carriage assembly including a sensor for detecting the position of the pen carriage assembly as it travels along a rectilinear path of travel above the print medium;

a timing module, responsive to a series of encoder pulses generated by said sensor, said timing module generating an estimated polynomial equation of arbitrary order to approximate a position profile of said pen carriage assembly as it travels along said path of travel; and a resequencer responsive to said position profile for providing a series of sub pulses that represent estimates of when said pen carriage assembly will be at small increments in position based on the past behavior of the pen carriage assembly relative to its velocity and acceleration factors, wherein said resequencer generates an extrapolator sequence; and wherein said extrapolator sequence defines a set of polynomial difference equations in order to facilitate determining a new subsequence of other polynomial difference equations, wherein said set of polynomial difference equations are defined as follows:

C=a third order constant;

$B_k=B_{k-1}+C$; and $A_k=A_{k-1}+B_{k-1}$, wherein:

k is an integer; and wherein $A_k$, $A_{k-1}$, and $B_k$, $B_{k-1}$ each represent time intervals.

2. A printing apparatus according to claim 1, wherein said set of other polynominal difference equations are defined as follows:

c=a third order constant;

$b_K=b_{K-1}+c$; and $a_K=a_{K-1}+b_{K-1}$.

3. A printing apparatus according to claim 2 wherein said set of polynominal difference equations and said new subsequence of other polynominal difference equations are of a third order as both have non-zero difference out to the third difference.

4. A printing apparatus according to claim 1, wherein said new subsequence of other polynominal difference equations is offset from the extrapolator sequence by at least one half of a subpulse interval for helping to reduce the likelihood of a last subpulse in the subsequence occurring either too close to an encoder pulse.

5. A printing apparatus according to claim 4, wherein said new subsequence of other polynominal difference equations is offset from the extrapolator sequence by at least one half of a subpulse interval for helping to reduce the likelihood of a last subpulse in the subsequence being hidden by a last encoder pulse due to errors in the predicted carriage movement.

6. A printer according to claim 1 wherein number of subpulses per encoder interval is given by n and wherein the relationship between the equations and other equations is defined by:

$$a_0 = A_0 * [(11/(12n)) + (1/(4n^2)) + (1/(48n^3))] - A_{-1} * [(7/(12n)) + (3/(8n^2)) + (1/(24n^3))] + A_{-2} * [(1/(6n)) + (1/(8n^2)) + (1/48n^3))];$$

$$a_1 = A_0 * [(11/(6n)) + (2/(n^2)) + (7/(24n^3))] - A_{-1} * [(7/(6n)) + (3/(n^2)) + (13/(12n^3))] + A_{-2} * [(1/(3n)) + (1/(n^2)) + (1/24n^3))];$$

$$b_1 = A_0 * [(2/n^2) + (1/(2n^3))] - A_{-1} * [(3/n^2)) + (1/n^3)] + A_{-2} * [(1/n^2) + (1/2n^3))]; \text{ and}$$

$$c = A_0 * [1/n^3] - A_{-1} * [2/n^3] + A_{-2} * [1/n^3].$$

7. A printing apparatus according to claim 1, further comprising:

a pen firing module responsive to said series of sub pulses for improving dot placement inaccuracies induced by said pen carriage assembly traveling at non uniform velocity rates.

8. A printing apparatus according to claim 1, further comprising:

a pen firing module responsive to said series of sub pulses for improving dot placement inaccuracies induced by said pen carriage assembly traveling at a uniform velocity rate.

9. A printing apparatus comprising;

a timing module for generating an estimated polynomial equation of arbitrary order to approximate a position profile of a carriage assembly as it travels along a defined path of travel; and a resequencer coupled to said timing module for generating an extrapolator sequence to facilitate predicting the future position of said pen carriage assembly; and wherein said extrapolator sequence defines a set of polynomial difference equations in order to facilitate determining a new subsequence of other polynomial difference equations.

10. A printing apparatus according to claim 9, wherein said set of polynomial difference equations are defined as follows:

C=a third order constant;

$B_k=B_{k-1}+C$; and $A_k=A_{k-1}+B_{k-1}$; and wherein k is an integer;

wherein the $A_k$, $A_{k-1}$ values represent time intervals between carriage position signals obtained by detecting movement of the pen carriage assembly;

wherein the $B_k$, $B_{k-1}$ values represent each represent time intervals in a difference sequence between consecutive Ak values; and wherein said resequencer is responsive to said position profile for providing a series of sub pulses that represent estimates of when said pen carriage assembly will be at small increments in position based on the past behavior of the pen carriage assembly relative to its velocity and acceleration factors.

11. A printing apparatus according to claim 9, further comprising:

a pen firing module responsive to said series of sub pulses for improving dot placement inaccuracies induced by said pen carriage unit traveling at non uniform velocity rates.

12. A printing apparatus according to claim 9, further comprising:

a pen firing module responsive to said series of sub pulses for improving dot placement inaccuracies induced by said pen carriage assembly traveling at a uniform velocity rate.

13. A method for correction carriage velocity induced ink drop positional errors, comprising:

detecting movement of a pen carriage assembly as it travels along a defined path of travel;

generating an extrapolator sequence; and wherein said extrapolator sequence defines a set of polynomial difference equations in order to facilitate determining a new subsequence of other polynomial difference equations:

wherein said set of polynomial difference equations are defined as follows:

C=a third order constant;

$B_k=B_{k-1}+C$; and $A_k=A_{k-1}+B_{k-1}$; and wherein k is an integer;

wherein the $A_k$, $A_{k-1}$ values represent time intervals between carriage position signals obtained by detecting movement of the pen carriage assembly;

wherein the $B_k$, $B_{k-1}$ values represent each represent time intervals in a difference sequence between consecutive Ak values.

* * * * *